US011484780B1

(12) United States Patent
Jiang

(10) Patent No.: US 11,484,780 B1
(45) Date of Patent: Nov. 1, 2022

(54) MAGNETIC LEVITATION MAGIC CUBE

(71) Applicant: GUANGZHOU GANYUAN INTELLIGENT TECHNOLOGY CO., LTD., Guangzhou (CN)

(72) Inventor: Ganyuan Jiang, Guangzhou (CN)

(73) Assignee: GUANGZHOU GANYUAN INIELLIGENT TECHNOLOGY CO., LTD., Guangzhou (CN)

( * ) Notice: Subject to any disclaimer, the term of this patent is extended or adjusted under 35 U.S.C. 154(b) by 0 days.

(21) Appl. No.: 17/367,277

(22) Filed: Jul. 2, 2021

(30) Foreign Application Priority Data

May 26, 2021 (CN) ..... 202110578663.1

(51) Int. Cl.
*A63F 9/34* (2006.01)
*A63F 9/08* (2006.01)

(52) U.S. Cl.
CPC ..... *A63F 9/34* (2013.01); *A63F 9/0842* (2013.01)

(58) Field of Classification Search
CPC ..... A63F 9/34; A63F 9/0842
See application file for complete search history.

(56) References Cited

U.S. PATENT DOCUMENTS

2020/0023266 A1* 1/2020 Lee ..... A63F 9/0842
2022/0008817 A1* 1/2022 Jiang ..... A63F 9/0842
2022/0118354 A1* 4/2022 Osipov ..... A63F 9/0842

FOREIGN PATENT DOCUMENTS

CN 110038293 A * 7/2019 ..... A63F 9/08
CN 210992929 U * 7/2020
CN 211097456 U * 7/2020
CN 212757183 U * 3/2021
CN 112827161 A * 5/2021
CN 214344363 U * 10/2021
CN 214512655 U * 10/2021
CN 214808367 U * 11/2021
CN 215538363 U * 1/2022

* cited by examiner

*Primary Examiner* — Steven B Wong

(57) ABSTRACT

A magnetic levitation magic cube includes edge blocks, corner blocks and center blocks. Inner sides of two side faces close to the corner blocks of the edge block each are provided with three magnet mounting grooves, and a magnet is mounted in each of the magnet mounting grooves. The center block includes a center block body and a center block cover. The center block cover covers and is spliced to the opening of the center block body. The center block further includes an upper magnetic disk and a lower magnetic disk. The upper magnetic disk is provided with a through-hole for fastening a central shaft of the magic cube. The lower magnetic disk is provided with a through-hole for the central shaft of the magic cube to pass through. Two repelling annular magnets are fixedly mounted in each of the upper magnetic disk and the lower magnetic disk.

10 Claims, 9 Drawing Sheets

MAGNETIC LEVITATION MAGIC CUBE

TECHNICAL FIELD

The present invention relates to a magic cube, and in particular, to a magnetic magic cube.

BACKGROUND

Currently, a conventional magic cube is a six-sided cube made of hard plastic rich in elasticity. The core is a shaft, and a magic cube consists of 26 blocks. The 26 blocks include 6 inner center blocks that are fixed and colored on only one side, 8 rotatable corner blocks, and 12 rotatable edge blocks. When the toy is ready for sale, each side of the cube can have the same color by arranging the blocks. When one side of the large cube is rotated by translation, a single color of each adjacent side of the large cube is disrupted, and a cube with a new pattern is formed. The cube changes again upon further rotation, and each side is spliced by blocks with different colors. The playing method is to restore the disordered cube back to a cube with a single color on each of the six sides as quickly as possible by rotation.

Since the advent, the magic cube has a very strong intelligence development function for human beings, and therefore it is popular around the world. The magic cube is easy to understand and ever changing and flexible, and therefore players must be able to concentrate their mentality, keep thinking and be patient in order to play the magic cube well. In a sense, the magic cube has become a special intelligence development toy and a toy for assessing the level and maturity of the players' intelligence, and therefore attract players batch after batch.

A more complex magic cube is usually adopted as a competition prop in a magic cube competition, and competitors need to rotate rapidly in order to complete the reordering of the magic cube in the shortest time. Rotation of the conventional magic cube relies on accurate rotation of a player, and the magic cube needs to be rotated by 90 degrees each time, so that the magic cube is not easily stuck. A magic cube with magnetic positioning blocks maybe attracted by magnetic attraction force in a state of 90 degrees, thereby achieving more accurate positioning.

However, existing magnetic magic cubes have the following defects.

1. Some existing magnetic magic cubes have positioning magnets in edge blocks. When magnetic force of the positioning magnets is too small, positioning may be inaccurate during high-speed rotation, positioning points may be missed, and the positioning magnets may swing around the positioning points. When the magnetic force of the positioning magnets is large, the resistance of start is relatively large upon initial rotation of the stationary magic cube, which is not conducive to fast restoration of the magic cube.

2. Some existing magnetic magic cubes have magnetic positioning apparatuses, typically magnets. The whole magic cube needs to be disassembled, and then the magnets can be attached to inner walls of blocks by glue or other chemical substances. However, glue is not environmentally friendly, assembly precision is relatively poor, and magnets are difficult to replace, the magnitude of magnetic force of each block is difficult to change and the magnitude of magnetic force of a layer where the blocks are located is difficult to change.

3. In most of existing magic cubes on the market, center blocks press corner blocks and edge blocks by elastic force of springs. Rotation force is adjusted by adjusting the elastic force. The springs are in contact with the center blocks, and therefore friction resistance is relatively large, which is not conducive to increasing a rotation speed.

4. In some existing magic cubes, an axis is in full contact with center blocks, and rotation resistance is relatively large.

5. In some existing magic cubes, elastic force and an axis distance are adjusted by screwing iron screws, and there is no obvious reference mark and positioning, and operations are not convenient or precise enough.

6. Magic cubes on the market cannot be effectively compatible with multiple levels of magnetic force and multiple levels of elastic force.

SUMMARY

To overcome the aforesaid defects in the prior art, a technical problem to be solved by the present invention is to provide a magnetic structure of a magic cube, which has a decelerating effect, improves positioning precision and reduces frictional force.

To solve the above technical problem, a technical solution used by the present invention is a magnetic levitation magic cube. The magnetic levitation magic cube includes edge blocks, corner blocks and center blocks.

Inner sides of two side faces close to the corner blocks of the edge block each are provided with three magnet mounting grooves. A magnet is mounted in each of the magnet mounting grooves.

The center block includes a center block body and a center block cover. The center block body is a hollow structure and is provided with an opening. The center block cover covers and is spliced to the opening of the center block body. The center block further includes an upper magnetic disk and a lower magnetic disk that are mounted inside the center block body. The upper magnetic disk is provided with a through-hole for fastening a central shaft of the magic cube. The lower magnetic disk is provided with a through-hole for the central shaft of the magic cube to pass through. An annular magnet is fixedly mounted in each of the upper magnetic disk and the lower magnetic disk, and the two annular magnets repel each other.

In a further technical solution, the magnet mounting grooves of each side face of the edge block include one primary positioning magnet mounting groove and two auxiliary decelerating magnet mounting grooves. A movement trajectory of the primary positioning magnet mounting groove does not coincide with movement trajectories of the auxiliary decelerating magnet mounting grooves. The two auxiliary decelerating magnet mounting grooves are located on two sides of the primary positioning magnet mounting groove respectively.

In a further technical solution, the edge block includes an edge block body and a color sheet. An outer end of the edge block body is provided with an opening. The color sheet is fastened to the opening of the edge block body. The magnet mounting grooves are arranged in positions close to the opening of the edge block body. The magnet mounting grooves each abuts against one end of the corresponding magnet. An inner surface of the color sheet is provided with inwardly-protruding pressing blocks. The pressing blocks each abuts against the other end of the corresponding magnet.

In a further technical solution, the upper magnetic disk includes an adjustment disk and an upper magnetic disk base. A lower end face of the adjustment disk is provided with first adjustment teeth. An upper end face of the upper magnetic disk is provided with an adjustment tooth surface.

A lower end of the upper magnetic disk is provided with a magnet groove for accommodating the corresponding annular magnet.

In a further technical solution, an outer peripheral edge of the upper magnetic disk base is provided with a side wall capable of driving the upper magnetic disk base to rotate.

In a further technical solution, an upper surface of the adjustment disk is provided with an indication disk. The indication disk is provided with several indication surfaces. A width of the indication surface matches a width of the first adjustment tooth.

In a further technical solution, an inner bottom face of the center block body is provided with a connecting column. A circumferential surface of the connecting column is provided with second adjustment teeth. A through-hole of the lower magnetic disk sleeves the connecting column. An outer peripheral edge of the through-hole of the lower magnetic disk is provided with third adjustment teeth matching the second adjustment teeth.

In a further technical solution, the lower magnetic disk is provided with several sockets capable of driving the lower magnetic disk to rotate.

In a further technical solution, the sockets of the lower magnetic disk are insertion sockets in the peripheral edge of the lower magnetic disk.

In a further technical solution, an inner surface of the bottom of the center block body is provided with several indication scale markings. A peripheral edge of the lower magnetic disk is provided with several notches.

In the magnetic levitation magic cube of the present invention, three magnets are adopted for positioning in the edge block to make positioning more precise and further avoid large resistance of start; two annular magnets repelling each other are adopted in the center block to realize repulsive force; and the annular magnets are not in contact with the central shaft of the magic cube to reduce frictional force. In addition, by adopting the mutually-matching structures, the positions and axis distance between the magnets are adjusted, and the axis distance and magnetic repulsive force are effectively adjusted.

DESCRIPTION OF EMBODIMENTS

Figure 1:
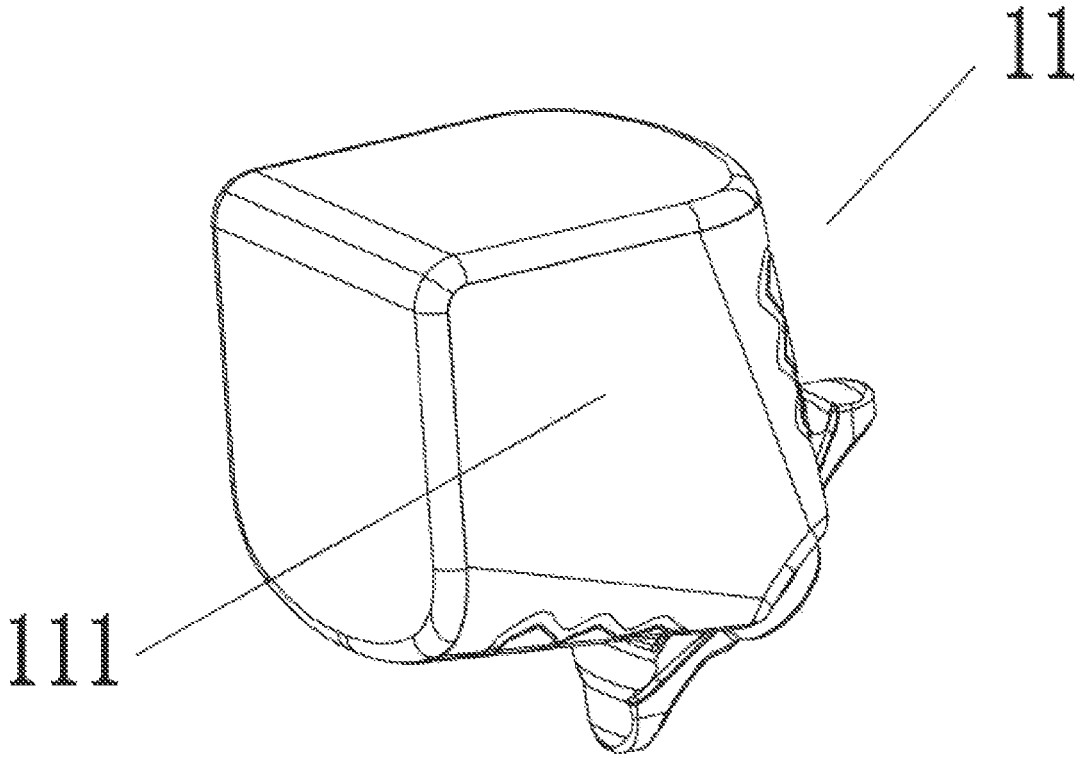
FIG. 1 is a schematic structural diagram illustrating an edge block according to the present invention.

The following further describes the present invention in conjunction with the accompanying drawings and specific embodiments.

As shown in FIG. 1, FIG. 2, and FIG. 12 to FIG. 15, a magnetic levitation magic cube according to the present invention includes edge blocks 11, corner blocks 3 and center blocks 2. Inner sides of two side faces 111 close to the corner blocks (not shown in figures) of the edge block 11 each are provided with three magnet mounting grooves 121. A magnet 14 is mounted in each of the magnet mounting grooves 121. Further, the magnet mounting grooves 121 of each side face 111 of the edge block 11 are arrayed in a triangle pattern, i.e., the magnets 14 are arrayed in the triangle pattern. In particular, the magnet mounting grooves 121 of each side face 111 of the edge block include one primary positioning magnet mounting groove 1211 and two auxiliary decelerating magnet mounting grooves 1212. A movement trajectory of the primary positioning magnet mounting groove 1211 does not coincide with movement trajectories of the auxiliary decelerating magnet mounting grooves 1212. The two auxiliary decelerating magnet mounting grooves 1212 are located on two sides of the primary positioning magnet mounting groove 1211 respectively. Because the edge block can rotate during use of the magic cube, the magnets 14 mounted in the edge block can also rotate along with the edge block. Also, the rotation axis of the edge block is fixed, and thus rotation trajectories of the magnet mounting grooves 121 are fixed. The movement trajectory of the primary positioning magnet mounting groove 1211 does not coincide with the movement trajectories of the auxiliary decelerating magnet mounting grooves 1212, such that the magnets mounted in the auxiliary decelerating magnet mounting grooves 1212 can be staggered from magnets on the corner blocks, thereby assisting in deceleration and also greatly reducing the thrust of start for rotating the stationary magic cube.

Figure 2:
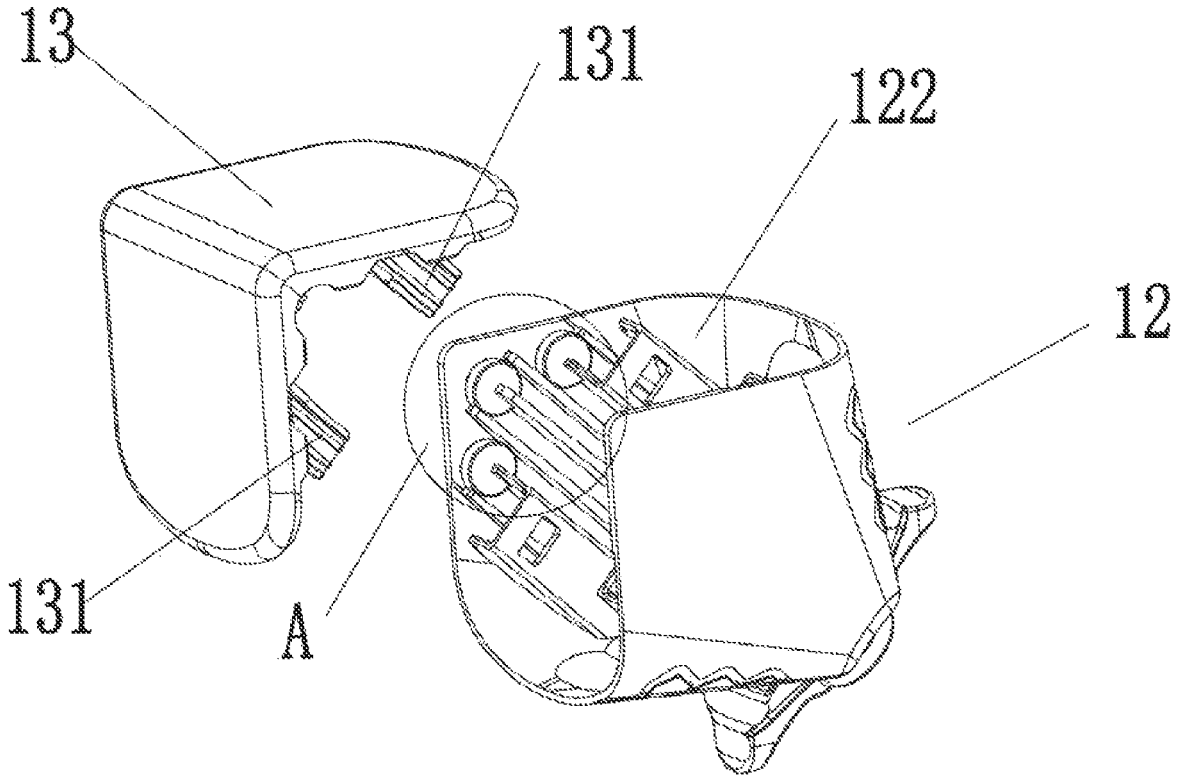
FIG. 2 is a schematic structural diagram illustrating assembling of an edge block according to the present invention.
Figure 3:
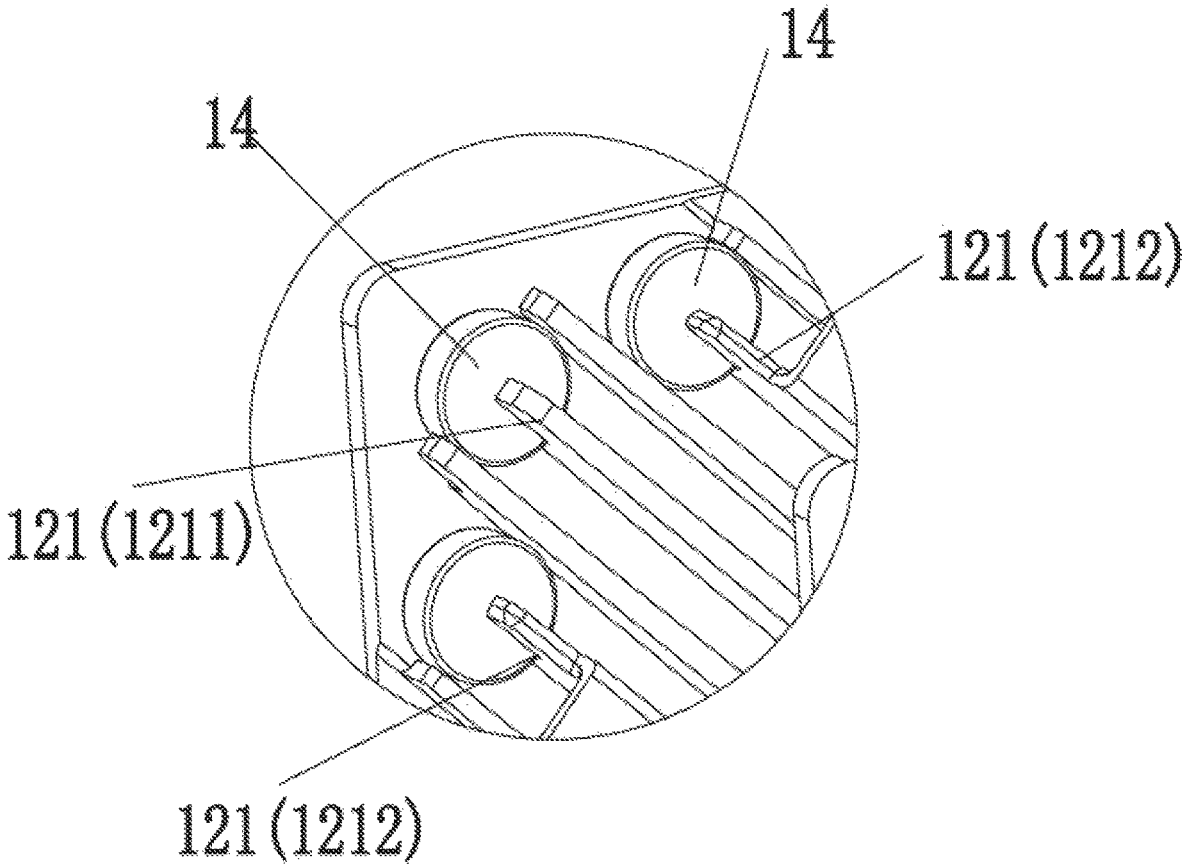
FIG. 3 is a schematic enlarged view of area A in FIG. 2.

As shown in FIG. 2 and FIG. 3, the edge block 11 includes an edge block body 12 and a color sheet 13. An outer end of the edge block body 12 is provided with an opening 122. The color sheet 13 is fastened to the opening 122 of the edge block body 12. The magnet mounting grooves 121 are arranged in positions close to the opening 122 of the edge block body 12. The magnet mounting grooves 121 each abuts against one end of the corresponding magnet 14. An inner surface of the color sheet 13 is provided with inwardly-protruding pressing blocks 131. The pressing blocks 131 each abuts against the other end of the corresponding magnet 14. In the edge block 11, the magnets 14 are placed in the magnet mounting grooves 121 and then pressed by the color sheet 13, which is stable and reliable. The magnets 14 are not attached to an inner wall of the block by glue or other chemical substances, which is safe, environmentally friendly and accurate and reliable in position.

Figure 4:
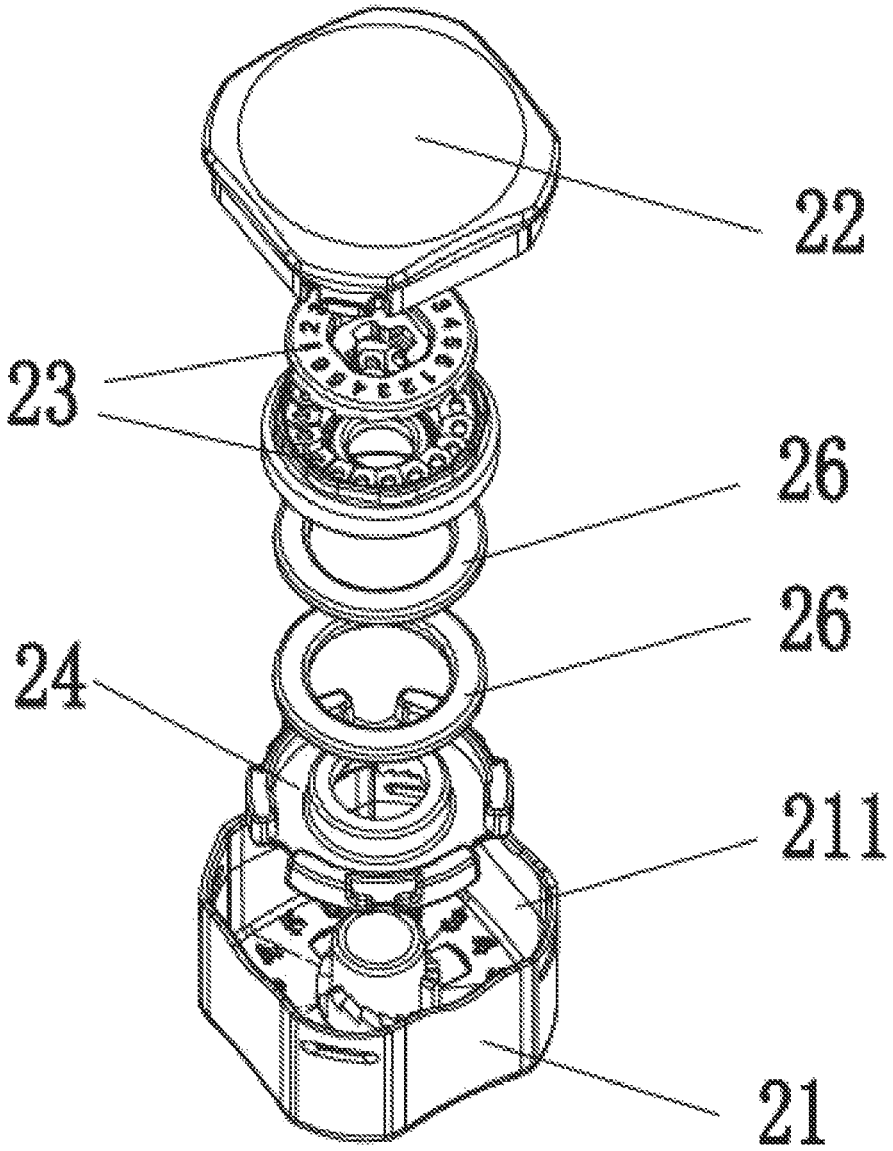
FIG. 4 is a schematic structural diagram illustrating a center block according to the present invention.
Figure 5:
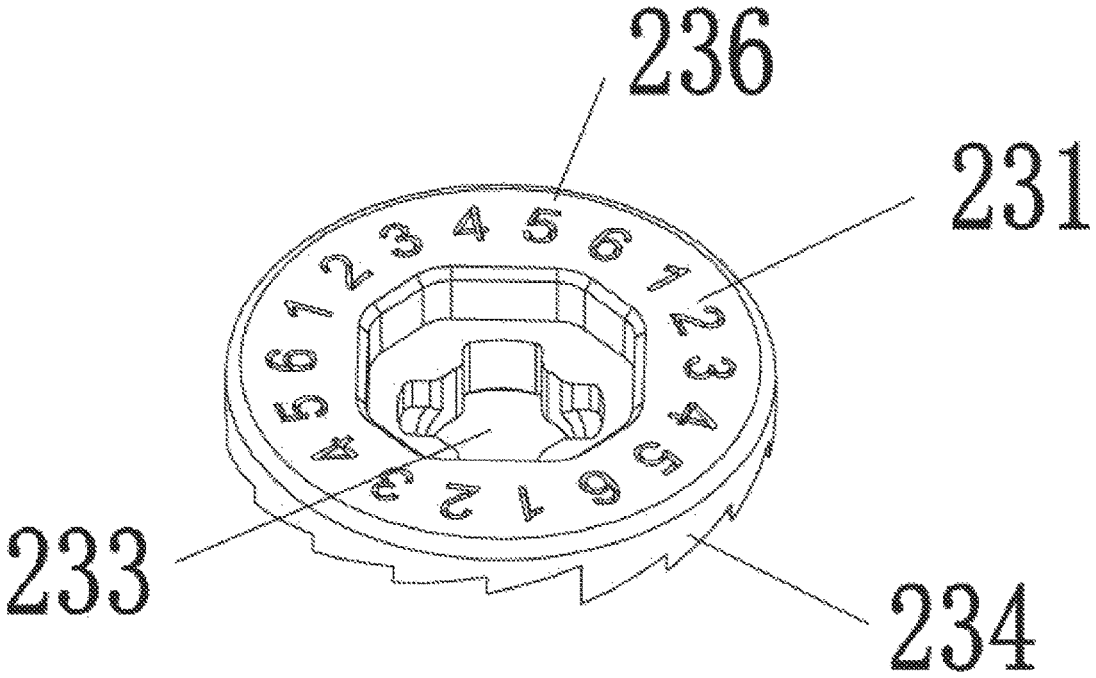
FIG. 5 is a schematic structural diagram illustrating an adjustment disk according to the present invention.
Figure 6:
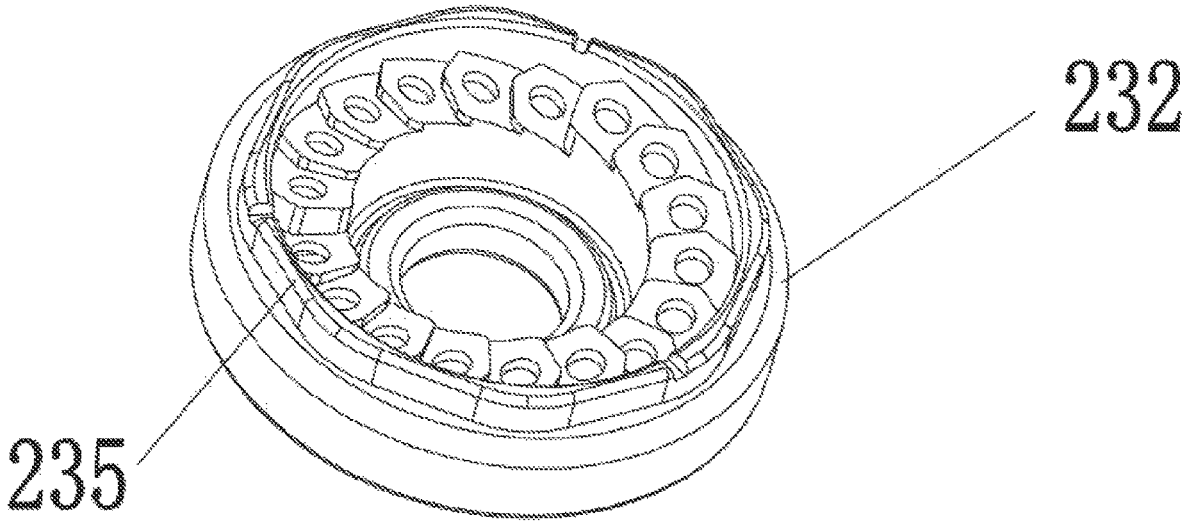
FIG. 6 is a schematic structural diagram illustrating an upper magnetic disk base according to the present invention.

As shown in FIG. 4, the center block of the magic cube based on magnetic levitation repulsive force of the present invention includes a center block body 21 and a center block cover 22. The center block body 21 is a hollow structure and is provided with an opening 211. The center block cover 22 covers and is spliced to the opening 211 of the center block body 21. The center block further includes an upper magnetic disk 23 and a lower magnetic disk 24 that are mounted inside the center block body 21. As shown in FIG. 5, the upper magnetic disk 23 is provided with a through-hole 233 for fastening a central shaft of the magic cube. As shown in FIG. 6, the lower magnetic disk 24 is provided with a through-hole for the central shaft of the magic cube to pass through. An annular magnet 26 is fixedly mounted in each of the upper magnetic disk 23 and the lower magnetic disk 24, and the two annular magnets 26 repel each other.

In particular, the upper magnetic disk 23 includes an adjustment disk 231 and an upper magnetic disk base 232. A lower end face of the adjustment disk 231 is provided with first adjustment teeth 234. An upper end face of the upper magnetic disk is provided with an adjustment tooth surface. A lower end of the upper magnetic disk is provided with a magnet groove for accommodating the corresponding annular magnet. An upper end of the adjustment disk is further provided with a groove 235 capable of driving the adjustment disk to rotate. An outer peripheral edge of the upper magnetic disk base is provided with a side wall 235 capable of driving the upper magnetic disk base to rotate. An upper surface of the adjustment disk 231 is provided with an indication disk. The indication disk is provided with several indication surfaces 236. A width of the indication surface (i.e., a width of a gear indication number in the figure) matches a width of the first adjustment tooth 234, such that the adjustment disk 231 enables an accurate indication when being rotated by a width of one adjustment tooth (i.e., one gear).

Figure 7:
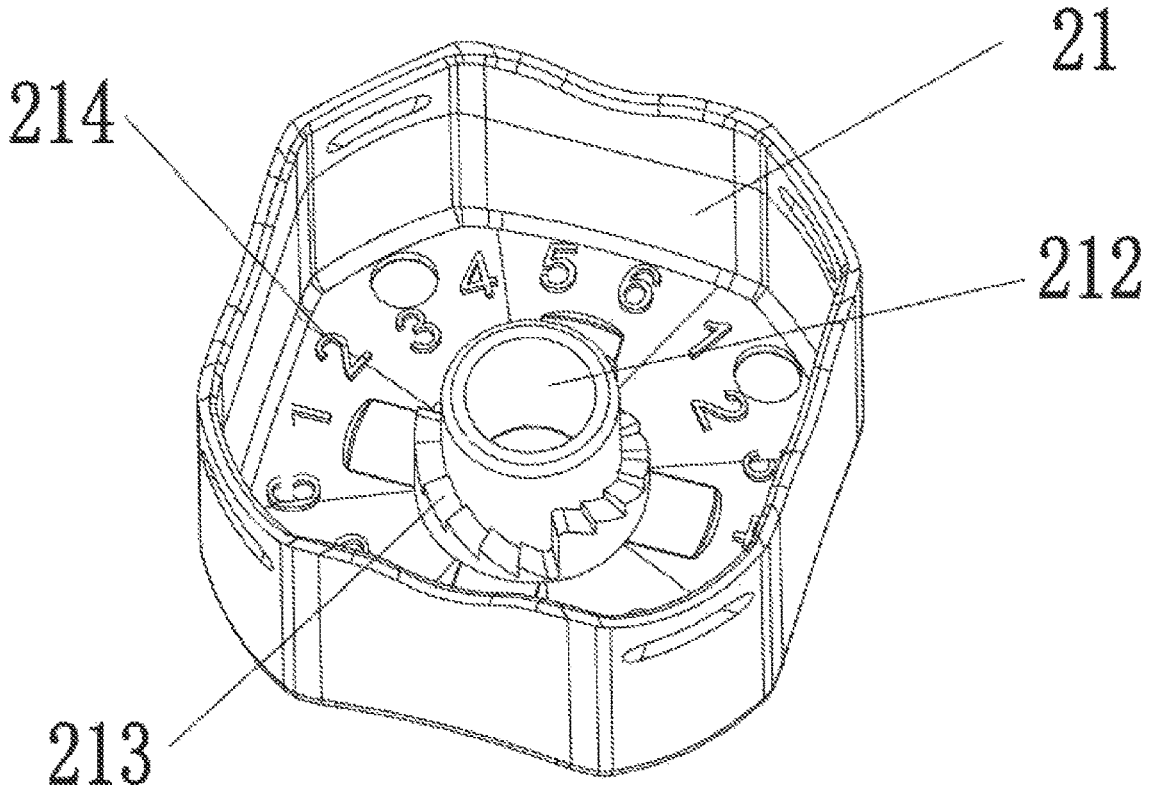
FIG. 7 is a schematic structural diagram illustrating a center block body according to the present invention.
Figure 8:
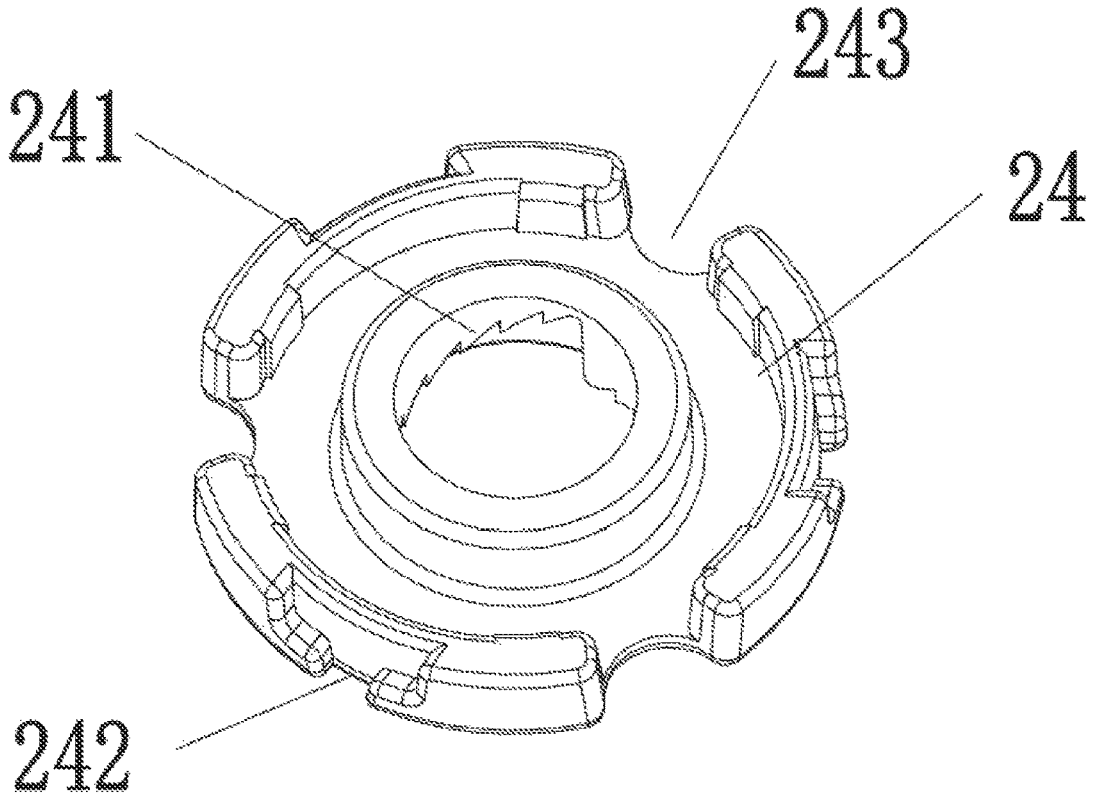
FIG. 8 is a schematic structural diagram illustrating a lower magnetic disk according to the present invention.
Figure 9:
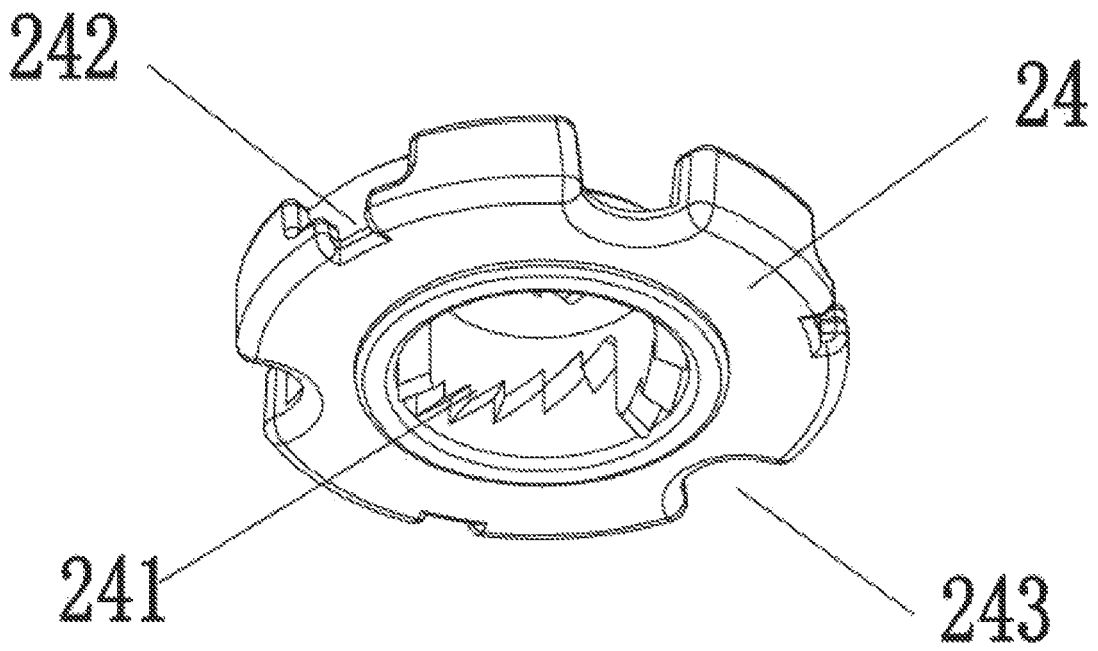
FIG. 9 is a schematic structural diagram illustrating another viewing angle of a lower magnetic disk according to the present invention.

As shown in FIG. 7, an inner bottom face of the center block body 21 is provided with a connecting column 212. A circumferential surface of the connecting column 212 is provided with second adjustment teeth 213. As shown in FIG. 8 and FIG. 9, a through-hole of the lower magnetic disk 24 sleeves the connecting column 212. An outer peripheral edge of the through-hole of the lower magnetic disk 24 is provided with third adjustment teeth 241 matching the second adjustment teeth 213. The lower magnetic disk 24 is provided with several sockets capable of driving the lower magnetic disk 24 to rotate. The sockets of the lower magnetic disk 24 are insertion sockets 242 in the peripheral edge of the lower magnetic disk 24. An inner surface of the bottom of the center block body 21 is provided with several indication scale markings 214. The peripheral edge of the lower magnetic disk 24 is provided with several notches 243.

Figure 10:
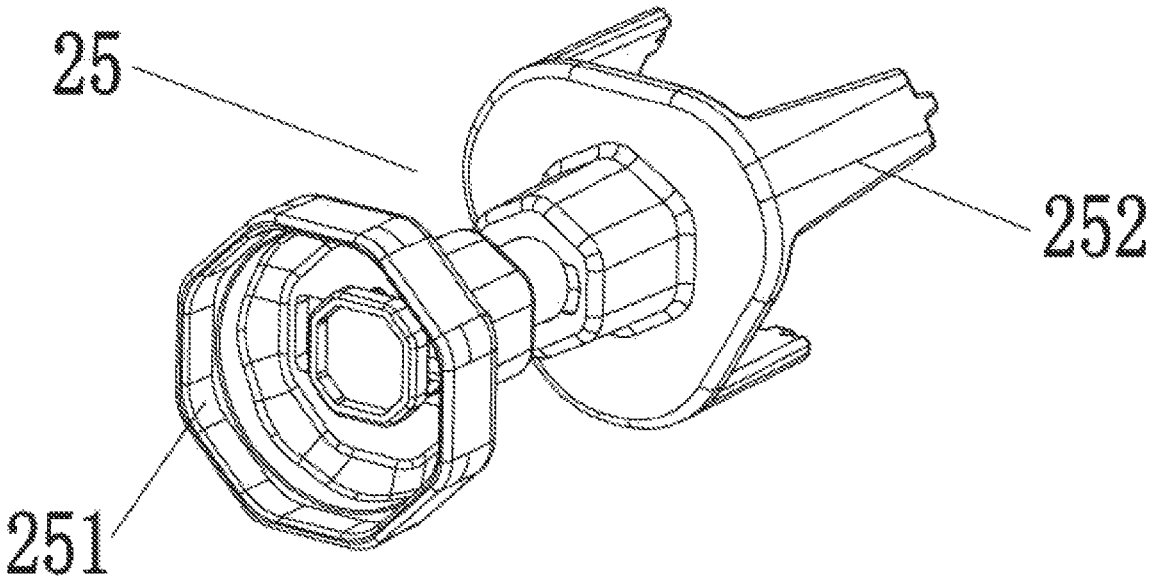
FIG. 10 is a schematic structural diagram illustrating an adjustment tool according to the present invention.

As shown in FIG. 10, the present invention further provides an adjustment tool 25 applied to the center block of the magic cube based on magnetic levitation repulsive force. An end face (a first end in the figure in this embodiment) of the adjustment tool 25 is provided with a sleeve 251 matching a side wall 235 of the upper magnetic disk base 232 in shape. In this embodiment, the side wall 235 defines an octagonal shape, and the sleeve 252 is in an octagonal shape accordingly. During actual implementation, different shapes may be adopted as long as rotation can be realized. Provided is a protrusion 251 matching the groove 235 of the adjustment disk 231 in shape. Due to the structure, after the center block cover 22 of the magic cube is opened, the protrusion/sleeve 251 of the adjustment tool 25 matches the groove/side wall 235 of the adjustment disk 231/upper magnetic disk base 232, and the adjustment disk 231/upper magnetic disk base 232 can be rotated by rotating the adjustment tool 25, thereby adjusting the axis distance.

Figure 11:
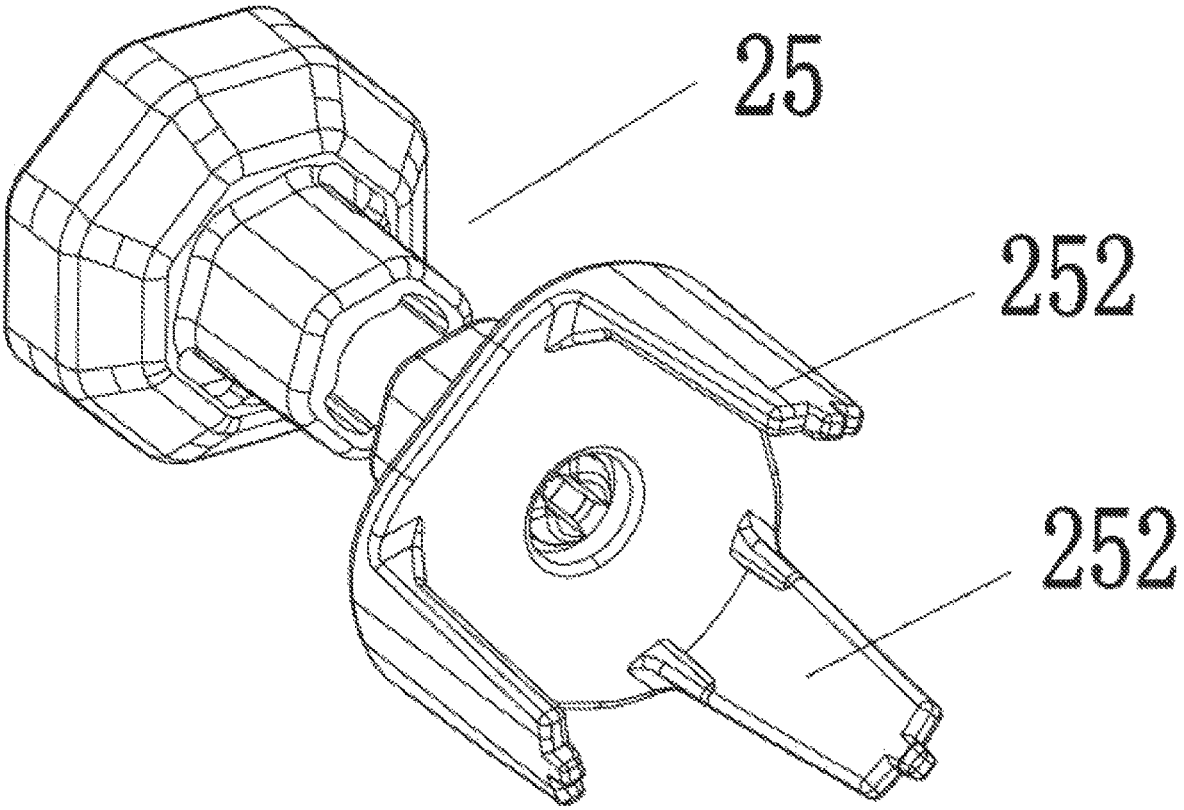
FIG. 11 is a schematic structural diagram illustrating another viewing angle of an adjustment tool according to the present invention.
Figure 12:
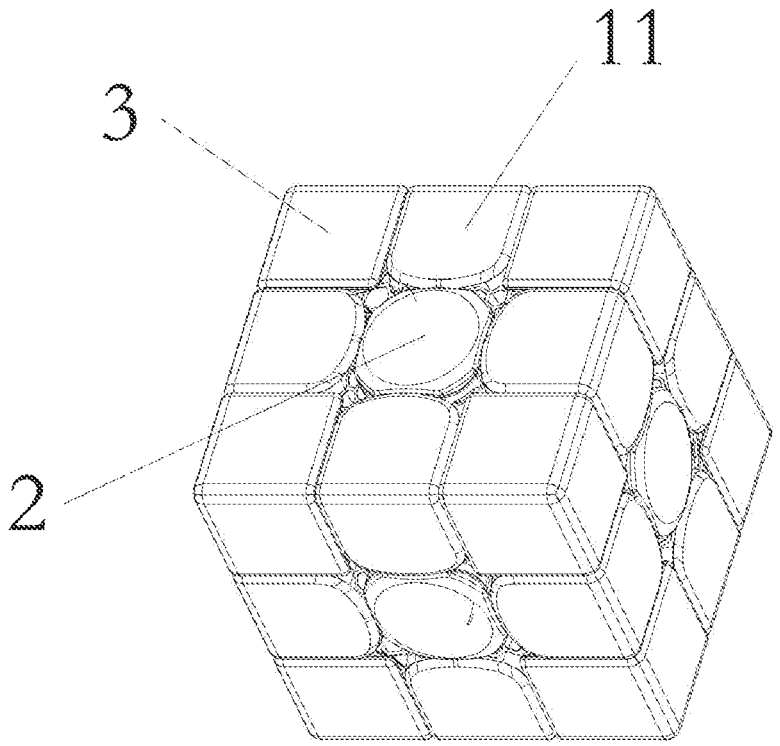
FIG. 12 is a schematic structural diagram illustrating a magic cube according to the present invention.
Figure 13:
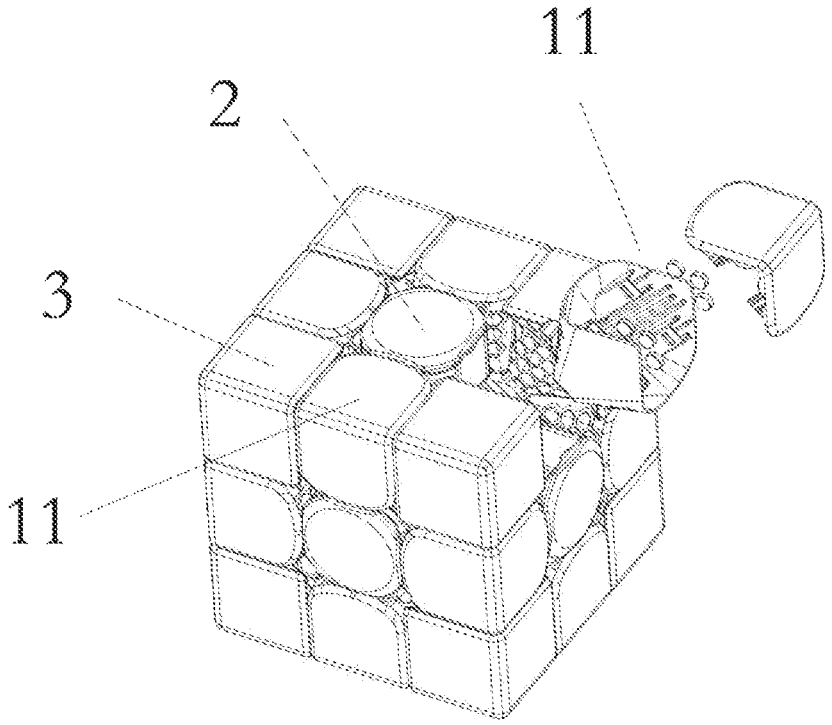
FIG. 13 is a schematic structural exploded diagram illustrating a magic cube according to the present invention.
Figure 14:
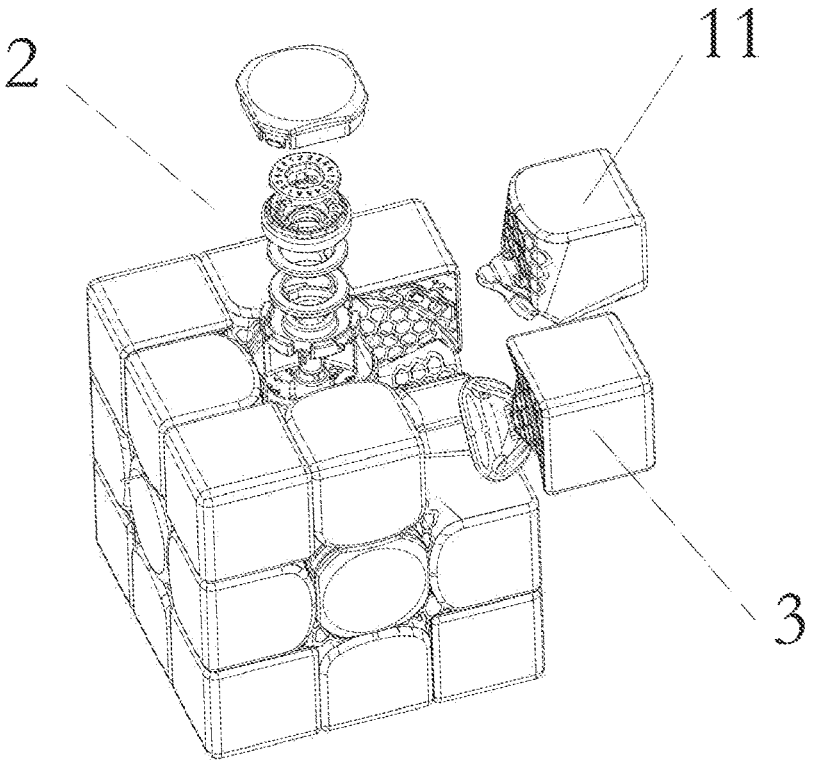
FIG. 14 is another schematic structural exploded diagram illustrating a magic cube according to the present invention.
Figure 15:
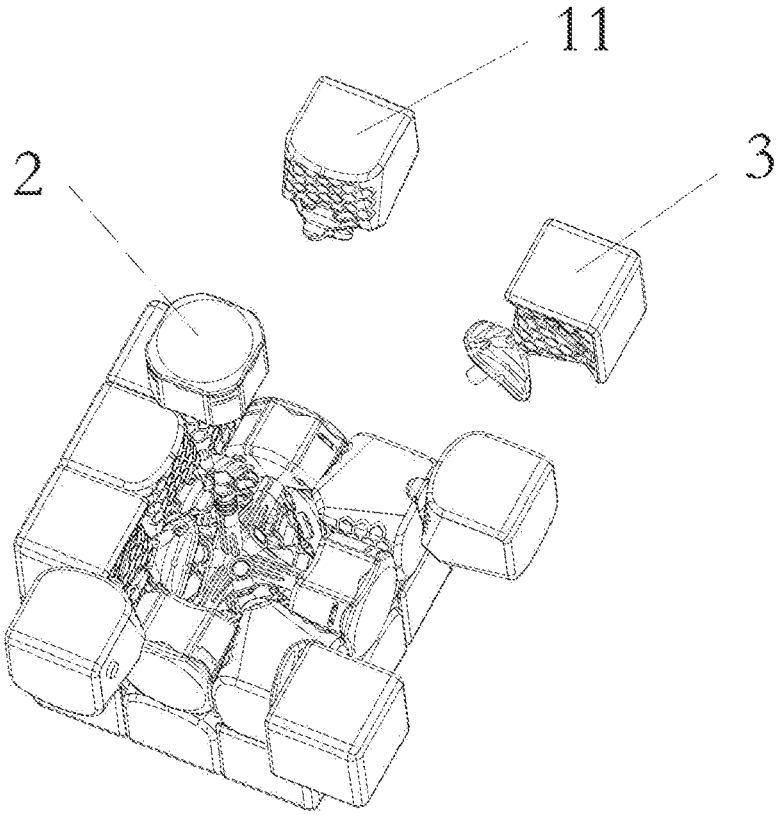
FIG. 15 is another schematic structural exploded diagram illustrating a magic cube according to the present invention.

As shown in FIG. 11, the present invention further provides another implementation of the adjustment tool 25. A peripheral edge of an end of the adjustment tool 25 is provided with several protruding plates 252. In this embodiment, the protruding plates 252 are disposed at the other end different from the protrusion 251. During actual implementation, the two ends can be divided into two tools. A shape of ends of the protruding plates 252 matches a shape of the insertion sockets 242 of the lower magnetic disk 24. A width of an area formed among the protruding plates 252 is larger than a width of the upper magnetic disk 23. When the protruding plates 252 are inserted into the insertion sockets 242 of the lower magnetic disk 24, the adjustment tool 25 can drive the lower magnetic disk 24 to rotate, thereby adjusting a height of the lower magnetic disk 24, a distance between two annular magnets 26, and then the magnitude of magnetic repulsive force.

The foregoing describes only the preferred implementations of the present invention, but is not intended to limit the present invention. Various modifications or variations made to the present invention in practice that do not depart from the spirit and scope of the present invention but fall within the scope of the claims of the present invention and equivalents shall also be included in the present invention.

What is claimed is:

1. A magnetic levitation magic cube, comprising edge blocks, corner blocks and center blocks, wherein inner sides of two side faces of each of the edge blocks close to a corresponding corner block are provided with three magnet mounting grooves; a magnet is mounted in each of the magnet mounting grooves;

each of the center blocks comprises a center block body and a center block cover, each center block body is a hollow structure and is provided with an opening, and each center block cover covers and is spliced to the opening of a corresponding center block body; each of the center blocks further comprises an upper magnetic disk and a lower magnetic disk that are mounted inside each center block body; each upper magnetic disk is provided with a first through-hole for fastening a central shaft of the magnetic levitation magic cube; each lower magnetic disk is provided with a second through-hole for the central shaft of the magnetic levitation magic cube to pass through; and an annular magnet is fixedly mounted in each upper magnetic disk and each lower magnetic disk, and each annular magnet mounted in each upper magnetic disk repels each annular magnet mounted in the lower magnetic disk.

2. The magnetic levitation magic cube according to claim 1, wherein the three magnet mounting grooves provided on each of the side faces of each of the edge blocks comprise one primary positioning magnet mounting groove and two auxiliary decelerating magnet mounting grooves; and a movement trajectory of each primary positioning magnet mounting groove does not coincide with movement trajectories of corresponding two auxiliary decelerating magnet mounting grooves, and the corresponding two auxiliary decelerating magnet mounting grooves are located on two sides of each primary positioning magnet mounting groove.

3. The magnetic levitation magic cube according to claim 2, wherein each of the edge blocks comprises an edge block body and a color sheet; an outer end of each edge block body is provided with an opening, and each color sheet is fastened to the opening of a corresponding edge block body; the three magnet mounting grooves of each of the edge blocks are arranged in positions close to the opening of a corresponding edge block body; each of the magnet mounting grooves abuts against a first end of a corresponding magnet; and an inner surface of each color sheet is provided with inwardly-protruding pressing blocks, and each of the pressing blocks abuts against a second end of a corresponding magnet.

4. The magnetic levitation magic cube according to claim 1, wherein each upper magnetic disk comprises an adjustment disk and an upper magnetic disk base; a lower end face of each adjustment disk is provided with first adjustment teeth; an upper end face of each upper magnetic disk is provided with an adjustment tooth surface; and a lower end of each upper magnetic disk is provided with a magnet groove for accommodating a corresponding annular magnet.

5. The magnetic levitation magic cube according to claim 4, wherein an outer peripheral edge of each upper magnetic disk base is provided with a side wall capable of driving a corresponding upper magnetic disk base to rotate.

6. The magnetic levitation magic cube according to claim 5, wherein an upper surface of each adjustment disk is provided with an indication disk, each indication disk is provided with a plurality of indication surfaces, and a width of each of the indication surfaces matches a width of each of the first adjustment teeth.

7. The magnetic levitation magic cube according to claim 1, wherein an inner bottom face of each center block body is provided with a connecting column, and a circumferential surface of each connecting column is provided with second adjustment teeth; and each connecting column passes through the through-hole of a corresponding lower magnetic disk, and an outer peripheral edge of the through-hole of each lower magnetic disk is provided with third adjustment teeth matching corresponding second adjustment teeth.

8. The magnetic levitation magic cube according to claim 7, wherein each lower magnetic disk is provided with a plurality of sockets capable of driving a corresponding lower magnetic disk to rotate.

9. The magnetic levitation magic cube according to claim 8, wherein the sockets of each lower magnetic disk are insertion sockets arranged on a peripheral edge of each lower magnetic disk.

10. The magnetic levitation magic cube according to claim 9, wherein an inner bottom surface of each center block body is provided with a plurality of indication scale markings, and the peripheral edge of each lower magnetic disk is provided with a plurality of notches.

* * * * *